US011781232B2

(12) United States Patent
Räisä et al.

(10) Patent No.: US 11,781,232 B2
(45) Date of Patent: Oct. 10, 2023

(54) AQUEOUS ELECTROPLATING BATH AND ITS USE

(71) Applicant: Savroc Ltd, Kuopio (FI)

(72) Inventors: Jussi Räisä, Kuopio (FI); Arto Yli-Pentti, Klaukkala (FI)

(73) Assignee: Savroc Ltd, Kuopio (FI)

( * ) Notice: Subject to any disclaimer, the term of this patent is extended or adjusted under 35 U.S.C. 154(b) by 0 days.

(21) Appl. No.: 17/996,642

(22) PCT Filed: Apr. 21, 2021

(86) PCT No.: PCT/FI2021/050299

§ 371 (c)(1),
(2) Date: Oct. 20, 2022

(87) PCT Pub. No.: WO2021/214391

PCT Pub. Date: Oct. 28, 2021

(65) Prior Publication Data

US 2023/0127810 A1 Apr. 27, 2023

(30) Foreign Application Priority Data

Apr. 23, 2020 (FI) ..... 20205408

(51) Int. Cl.

| | |
|---|---|
| ***C25D 3/06*** | (2006.01) |
| ***C25D 3/10*** | (2006.01) |
| ***C25D 5/00*** | (2006.01) |
| ***C25D 5/14*** | (2006.01) |

(52) U.S. Cl.

CPC ..... *C25D 3/06* (2013.01); *C25D 3/10* (2013.01); *C25D 5/14* (2013.01); *C25D 5/617* (2020.08)

(58) Field of Classification Search

None

See application file for complete search history.

(56) References Cited

U.S. PATENT DOCUMENTS

| | | | | |
|---|---|---|---|---|
| 4,093,521 | A | 6/1978 | Renton et al. | |
| 4,184,929 | A | 1/1980 | Tomaszewski et al. | |
| 4,690,735 | A | 9/1987 | Laitinen et al. | |
| 5,415,763 | A * | 5/1995 | Johnson | C25D 3/06 205/290 |
| 5,759,243 | A | 6/1998 | Johnson | |
| 2015/0361571 | A1 | 12/2015 | Miettinen et al. | |
| 2017/0009361 | A1 | 1/2017 | Dal Zilio et al. | |
| 2017/0159198 | A1 | 6/2017 | Miettinen et al. | |
| 2019/0040540 | A1 | 2/2019 | Raisa | |
| 2019/0309430 | A1 | 10/2019 | Sklar | |

FOREIGN PATENT DOCUMENTS

| | | |
|---|---|---|
| CN | 101392394 | 3/2009 |
| CN | 101410556 | 4/2009 |
| EP | 2980280 | 2/2016 |
| FR | 2331628 | 6/1977 |
| GB | 1482747 | 8/1977 |
| GB | 1592761 | 7/1981 |
| WO | 2016044708 | 3/2016 |
| WO | 2021214389 | 10/2021 |
| WO | 2021214391 | 10/2021 |

OTHER PUBLICATIONS

AU Application No. 2021260899 Office Action, dated Nov. 25, 2022 , 3 pages.

"FI Search Report for 20205408", dated Oct. 2, 2020 , 1 pg.

"PCT/FI2021/050299 International Preliminary Report on Patentability", dated Jun. 10, 2020 , 21 pgs.

"PCT/FI2021/050299 International Search Report and Written Opinion", dated Jul. 15, 2021 , 10 pgs.

"CN Application No. 202180030113.4 Office Action", Apr. 17, 23, 17 pages.

"CN Application No. 202180030423.6 Office Action", May 23, 2023, 12 pages.

Oduoza, et al., "Chromium Electroplating of Aluminium Alloys Using Electroless Nickel as Underlayer", Journal of Materials Science and Chemical Engineering, 20140101—ISSN 2327-6045, vol. 2, Nr:7, pp. 59-74, Jul. 1, 2014, 17.

* cited by examiner

*Primary Examiner* — Wojciech Haske

(74) *Attorney, Agent, or Firm* — DeLizio, Peacock, Lewin & Guerra, LLP

(57) ABSTRACT

An aqueous electroplating bath is disclosed. The aqueous trivalent chromium bath comprises:—trivalent chromium cations in an amount of 0.12-0.276 mol/l,—ammonium ions in an amount of 4.0-6.0 mol/l, and—carboxylate ions in an amount of 2.0-7.4 mol/l, and the molar ratio of trivalent chromium cations to the carboxylate ions is 0.016-0.099, and the pH of the aqueous trivalent chromium bath is 2-6.

18 Claims, No Drawings

AQUEOUS ELECTROPLATING BATH AND ITS USE

TECHNICAL FIELD

The present disclosure relates to an aqueous electroplating bath. The present disclosure further relates to the use of the aqueous electroplating bath.

BACKGROUND

Objects which are utilized in demanding environmental conditions often require e.g. mechanical or chemical protection, so as to prevent the environmental conditions from affecting the object. Protection to the object can be realized by applying a coating thereon, i.e., on the substrate. Disclosed are protective coatings for various purposes, hard-coatings that protect the substrate from mechanical effects and diffusion barriers for protection against chemical effects. However, further manners to produce hard-coatings in an environmentally friendly manner are needed.

SUMMARY

An aqueous electroplating bath is disclosed. The aqueous electroplating bath comprises:

trivalent chromium cations in an amount of 0.12-0.276 mol/l, ammonium ions in an amount of 4.0-6.0 mol/l, and carboxylate ions in an amount of 2.0-7.4 mol/l, and the molar ratio of trivalent chromium cations to the carboxylate ions is 0.016-0.099, and the pH of the aqueous trivalent chromium bath is 2-6.

Further is disclosed the use of the aqueous electroplating bath as disclosed in the current application for producing a chromium-based coating on a substrate, wherein the chromium-based coating has a Vickers microhardness value of 700-1200 HV.

DETAILED DESCRIPTION

The present disclosure relates to an aqueous electroplating bath is disclosed. The aqueous electroplating bath comprises:

trivalent chromium cations in an amount of 0.12-0.276 mol/l, ammonium ions in an amount of 4.0-6.0 mol/l, and carboxylate ions in an amount of 2.0-7.4 mol/l, and the molar ratio of trivalent chromium cations to the carboxylate ions is 0.016-0.099, and the pH of the aqueous trivalent chromium bath is 2-6.

Further the present disclosure relates to the use of the aqueous electroplating bath as disclosed in the current application for producing a chromium-based coating on a substrate, wherein the chromium-based coating has a Vickers microhardness value of 700-1200 HV.

In one embodiment, the chromium-based coating has a Vickers microhardness value of 800-1100 HV, or 910-1000 HV. In one embodiment, the chromium-based coating has a Vickers microhardness value of 910-1200 HV. The Vickers microhardness may be determined according to standard ISO 14577-1:2015.

In this specification, unless otherwise stated, the terms "electroplating", "electrolytic plating" and "electrodeposition" are to be understood as synonyms. A chromium-based coating may be produced on a substrate by an electroplating process, wherein the chromium-based coating may be deposited from the aqueous electroplating bath as disclosed in the current application. The chromium-based coating may comprise one or more chromium-containing layers. By depositing a chromium-based coating or a chromium-containing layer on the substrate is herein meant depositing a coating or a layer directly on the substrate to be coated.

By a "substrate" is herein meant any component or body on which the chromium-based coating is coated or deposited on. Generally, the chromium-based coating can be used on variable substrates. In one embodiment, the substrate comprises or consists of metal, a combination of metals, or a metal alloy. In one embodiment, the substrate is made of steel, copper, nickel, iron, or any combination thereof. The substrate can be made of ceramic material. The substrate does not need to be homogenous material. In other words, the substrate may be heterogeneous material. The substrate can be layered. For example, the substrate can be a steel object coated by a layer of nickel, or nickel phosphorus alloy (Ni—P). In one embodiment, the substrate is a cutting tool, for example a cutting blade. In one embodiment, the substrate is a cutting tool comprising metal.

The aqueous electroplating bath as disclosed in the current specification is an aqueous electroplating bath comprising trivalent chromium cations. The chromium present in the aqueous electrolytic bath is thus present substantially only in the trivalent form.

The molar ratio of trivalent chromium cations to the carboxylate ions is 0.016-0.099 in the aqueous electroplating bath. In one embodiment, the molar ratio of trivalent chromium cations to the carboxylate ions is 0.02-0.09, 0.03-0.08, or 0.055-0.075. The inventors surprisingly found out that the specified molar ratio of the trivalent chromium cations to the carboxylate ions has the added utility of enabling to omit, if desired, the usually required heat treatment of the deposited chromium-containing layer(s) to achieve a hard chromium-based coating.

Any soluble trivalent chromium salt(s) may be used as the source of the trivalent chromium cations. Examples of such trivalent chromium salts are potassium chromium sulfate, chromium(III)acetate, chromium(III)formate, and chromium(III)chloride.

In one embodiment, the source of carboxylate ions is a carboxylic acid. In one embodiment, the source of the carboxylate ions is formic acid, acetic acid, or citric acid. In one embodiment, the source of the carboxylate ions is formic acid. In one embodiment, the source of the carboxylate ions is formic acid together with acetic acid and/or citric acid.

In one embodiment, the aqueous electroplating bath comprises trivalent chromium cations in an amount of 0.12-0.276 mol/l, or 0.13-0.24 mol/l, or 0.17-0.21 mol/l.

The aqueous electroplating bath may contain iron cations and/or nickel cations. The aqueous electroplating bath may contain iron cations and/or nickel cations in an amount of 0.0-6.16 mmol/l. The nickel ions may have the added utility of decreasing the potential needed in cell potential. In one embodiment, the aqueous electroplating bath comprises iron cations in an amount of 0.18-3.6 mmol/l, or 0.23-0.4 mmol/l. In one embodiment, the aqueous electroplating bath comprises nickel cations in an amount of 0.0-2.56 mmol/l, or 0.53-1.2 mmol/l. In one embodiment, the aqueous electroplating bath comprises iron cations and nickel cations in an amount of 0.18-6.16 mmol/l, or 0.76-1.6 mmol/l. In one embodiment, the aqueous electroplating bath comprises iron cations but not nickel cations. In one embodiment, the aqueous electroplating bath comprises nickel cations but not iron cations. In one embodiment, the aqueous electroplating bath comprises both iron cations and nickel cations.

In one embodiment, the aqueous electroplating bath comprises carboxylate ions in an amount of 2.0-7.4 mol/l, or 2.0-6.0 mol/l, or 2.8-4 mol/l. The amount of carboxylate ions in the aqueous electroplating bath has the added utility of increasing the amount of complex forming ions, whereby the stability of the aqueous electroplating bath is increased. Further, the buffering effect may also be increased.

In one embodiment, the aqueous electroplating bath comprises a bromide ions in an amount of 0.15-0.3 mol/l, 0.21-0.25 mol/l. In one embodiment, the source of the bromide ions is selected from a group consisting of potassium bromide, sodium bromide, ammonium bromide, and any combination or mixture thereof. In one embodiment, the source of the bromide ions is potassium bromide, sodium bromide, or ammonium bromide. The use of the bromide, such as potassium bromide, may have the added utility of efficiently preventing the formation of hexavalent chromium at the anode of the electroplating system.

In one embodiment, the aqueous electroplating bath comprises ammonium ions in an amount of 4.0-6.0 mol/l, or 4.5-5.5 mol/l, or 4.8-5.2 mol/l, or 4.9-5.1 mol/l. The use of ammonium ions have the added utility of providing conductance to the aqueous electroplating bath. The use of ammonium ions have the added utility of forming a complex with the chromium. In one embodiment, the source of the ammonium ions is selected from a group consisting of ammonium chloride, ammonium sulfate, ammonium formate, ammonium acetate, and any combination or mixture thereof In one embodiment, the pH of the aqueous electroplating bath may be 2-6, or 3-5.5, or 4.5-5, or 4.1-5. The pH may be adjusted by including a base in the aqueous electroplating bath when needed. Ammonium hydroxide, sodium hydroxide, and potassium hydroxide may be mentioned as examples of bases that may be used for adjusting the pH of the aqueous electroplating bath. In one embodiment, the aqueous electroplating bath comprises ammonium hydroxide, sodium hydroxide, and/or potassium hydroxide. In one embodiment, the aqueous electroplating bath comprises a base in an amount of 0.05-3.1 mol/l, or 0.5-1.5 mol/l, or 1.4-1.8 mol/l.

In one embodiment, the conductivity of the aqueous electroplating bath is 160-400 mS/cm, 200-350 mS/cm, or 250-300 mS/cm. The conductivity of the aqueous electroplating bath may be adjusted with the use of e.g. different salts for conductivity. Ammonium chloride, potassium chloride, and sodium chloride can be mentioned as examples of salts that may be used to adjust the conductivity. The conductivity may be determined e.g. in compliance with standard EN 27888 (water quality; determination of electrical conductivity (ISO 7888:1985)).

The aqueous electroplating bath as disclosed in the current specification has the added utility of the aqueous electroplating bath comprising more complex forming ions, whereby the stability of the aqueous electroplating bath increases. The aqueous electroplating bath of the current specification has the added utility of enabling the formation of a chromium-based coating on a substrate with a good adhesion to the substrate.

EXAMPLES

Reference will now be made in detail to various embodiments.

The description below discloses some embodiments in such a detail that a person skilled in the art is able to utilize the embodiments based on the disclosure. Not all steps or features of the embodiments are discussed in detail, as many of the steps or features will be obvious for the person skilled in the art based on this specification.

Example 1—Preparing Aqueous Electroplating Baths

In this example different aqueous electroplating baths were produced.

The aqueous electroplating baths comprised the following:

| Component | Bath 1 | Bath 2 | Bath 3 |
|---|---|---|---|
| $Cr^{3+}$ [mol/l] | 0.19 | 0.19 | 0.13 |
| Molar ratio of $Cr^{3+}$ to formate ion or equivalent amount of carboxylate ions | 0.061 | 0.05 | 0.034 |
| $COOH^-$ ions [mol/l] | 3.1 | 3.78 | 3.78 |
| ammonium ions [mol/l] | 4.6 | 5.1 | 5.2 |
| KBr [mol/l] | 0.23 | 0.23 | 0.23 |
| Fe [mmol/l] | 0.0 | 0.11 | 0.27 |
| Ni [mmol/l] | 0.0 | 2.98 | 0.53 |
| water | balance | balance | balance |
| pH | 5.5 | 4.8 | 5 |
| Temperature of the bath during electroplating ° C. | 40 | 65 | 45 |

The aqueous electroplating bath was subjected to a normal initial plating, after which it was ready for use. The above aqueous electroplating baths were used to produce chromium-based coatings on substrates through the electroplating process. It was noticed that chromium-based coatings with suitable hardness values and good adhesion for further applications could be formed by using the above described aqueous electroplating baths.

It is obvious to a person skilled in the art that with the advancement of technology, the basic idea may be implemented in various ways. The embodiments are thus not limited to the examples described above; instead, they may vary within the scope of the claims.

The embodiments described hereinbefore may be used in any combination with each other. Several of the embodiments may be combined together to form a further embodiment. An aqueous electroplating bath and use disclosed herein, may comprise at least one of the embodiments described hereinbefore. It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items. The term "comprising" is used in this specification to mean including the feature(s) or act(s) followed thereafter, without excluding the presence of one or more additional features or acts.

The invention claimed is:

1. An aqueous electroplating bath comprising:

trivalent chromium cations in an amount of 0.12-0.276 moles/liter (mol/l), ammonium ions in an amount of 4.5-6.0 mol/l, and carboxylate ions in an amount of 2.0-7.4 mol/l, and wherein the molar ratio of the trivalent chromium cations to the carboxylate ions is 0.016-0.099, and wherein the pH of the aqueous electroplating bath is 2-6.

2. The aqueous electroplating bath of claim 1, wherein the molar ratio of the trivalent chromium cations to the carboxylate ions is 0.02-0.09.

3. The aqueous electroplating bath of claim 1, further comprising bromide ions in an amount of 0.15-0.3 mol/l.

4. The aqueous electroplating bath of claim 1, wherein the ammonium ions are in an amount of 4.5-5.5 mol/l.

5. The aqueous electroplating bath of claim 1, wherein the carboxylate ions are in an amount of 2.0-6.0 mol/l.

6. The aqueous electroplating bath of claim 1, further comprising iron cations and/or nickel cations in an amount of 0-6.16 millimoles per liter (mmol/l).

7. The aqueous electroplating bath of claim 1, wherein the source of the carboxylate ions is formic acid.

8. The aqueous electroplating bath of claim 1, wherein the pH of the aqueous electroplating bath is 3-5.5.

9. The aqueous electroplating bath of claim 1, wherein the conductivity of the aqueous electroplating bath is 160-400 milli-siemens per centimeter (mS/cm).

10. A method comprising:

producing a chromium-based coating on a substrate using an aqueous electroplating bath that comprises trivalent chromium cations in an amount of 0.12-0.276 moles/liter (mol/l), ammonium ions in an amount of 4.0-6.0 mol/l, and carboxylate ions in an amount of 2.0-7.4 mol/l, wherein the molar ratio of the trivalent chromium cations to the carboxylate ions is 0.016-0.099, and wherein the pH of the aqueous electroplating bath is 2-6, wherein the chromium-based coating has a Vickers microhardness value of 700-1200 HV.

11. The method of claim 10, wherein the molar ratio of the trivalent chromium cations to the carboxylate ions is 0.02-0.09.

12. The method of claim 10, wherein the aqueous electroplating bath comprises bromide ions in an amount of 0.15-0.3 mol/l.

13. The method of claim 10, wherein the ammonium ions are in an amount of 4.5-5.5 mol.

14. The method of claim 10, wherein the carboxylate ions are in an amount of 2.0-6.0 mol/l.

15. The method of claim 10, wherein the aqueous electroplating bath comprises at least one of iron cations and nickel cations in an amount of 0-6.16 millimoles per liter (mmol/l).

16. The method of claim 10, wherein the source of the carboxylate ions is formic acid.

17. The method of claim 10, wherein the pH of the aqueous electroplating bath is 3-5.5.

18. The method of claim 10, wherein the conductivity of the aqueous electroplating bath is 160-400 milli-siemens per centimeter (mS/cm).

* * * * *